United States Patent [19]

Wilson, Sr.

[11] 4,355,201

[45] Oct. 19, 1982

[54] ELECTRIC FENCE WIRE MOUNTING STRUCTURE

[76] Inventor: Robert M. Wilson, Sr., 190 N. Eastway Dr., Battle Creek, Mich. 49016

[21] Appl. No.: 241,007

[22] Filed: Mar. 6, 1981

[51] Int. Cl.[3] ..... H01B 17/24; H01B 17/16

[52] U.S. Cl. ..... 174/166 R; 174/158 F; 174/169; 174/175

[58] Field of Search ..... 174/45 R, 158 R, 158 F, 174/161 F, 163 R, 163 F, 164, 166 R, 174, 169, 175; 248/218.4, 219.1, 219.3, 219.4, 231; 256/10

[56] References Cited

FOREIGN PATENT DOCUMENTS 659728 10/1951 United Kingdom ..... 174/175

*Primary Examiner*—Laramie E. Askin

*Attorney, Agent, or Firm*—Fisher, Gerhardt, Crampton & Groh

[57] ABSTRACT

An electric fence wire mounting structure for supporting a highly tensioned and electrically charged wire from a wooden fence post at either a corner or at the end of a line of fencing which includes a strap of electrically non-conductive material and an elongated metal retainer which are held in engagement with each other and are bendable as a unit to engage the surface of a cylindrical fence post. The mounting structure is fastened to the post by metal fasteners such as nails spaced from the metal strap.

12 Claims, 9 Drawing Figures

ELECTRIC FENCE WIRE MOUNTING STRUCTURE

This invention relates to electric fence wire mounting structures for supporting electrically charged fence wires from fence posts.

In many areas fences must be effective to contain domestic animals within a defined area and at the same time must be effective to keep out unwanted animals, particularly predators. To be effective for such purposes it has been found desirable that fences have the properties of electrically charged fences as well as the capability of operating mechanically since some predators will plunge through an electric fence where the charged wires are slack. Economical aspects dictate that such fences, particularly where vast stretches of land are to be fenced, require that the posts be widely separated, for example as much as seventy-five feet apart to save on the cost of posts. Also it is desirable to use high carbon steel wire stretched between the posts under a stress of as much as two hundred pounds to act mechanically to repell animals. Also it is common to use multiple strands of such wire more closely spaced than normal and to charge all of the strands electrically so that the strands act as both an electric and a mechanical fence.

Because of the wider spacing of posts and the high tensile loads on the wires it becomes difficult to support the wires at corner posts or to terminate a line of fencing at an end post such as encountered in a gate area or the like.

It is an object of the invention to provide a fence wire mounting structure particularly adapted to insulate the wire from the post and at the same time withstand large tensile loads such as those encountered at corner posts or posts at the end of a line of fencing.

Another object of the invention is to provide a fence wire mounting structure which can be attached to an intermediate portion of wire.

The objects of the invention are accomplished by a structure which includes an elongated flexible strap of electrically non-conductive material and an elongated metal member which is shorter and narrower than the insulated strap. The insulating strap and metal member are bendable as a unit to engage and encircle a cylindrical post. The insulating strap has a bracket arrangement to receive fasteners to secure the assembly to a post. In one embodiment the metal members are provided with tabs disposed in staggered relationship at opposite sides of a wire path. The tabs are bendable to entrap and hold the wire in position relative to the mounting structure. In another embodiment the wire is retained within a metal channel member by adjacent portions of the insulated strap. One length of either embodiment is adapted for use at corner posts and a longer length is adapted to encircle the greater portion of the post circumference for anchoring and mounting wires at posts located at the end of lines of fences.

These and other objects of the invention will become apparent from the following description and from the drawings in which.

Figure 2:
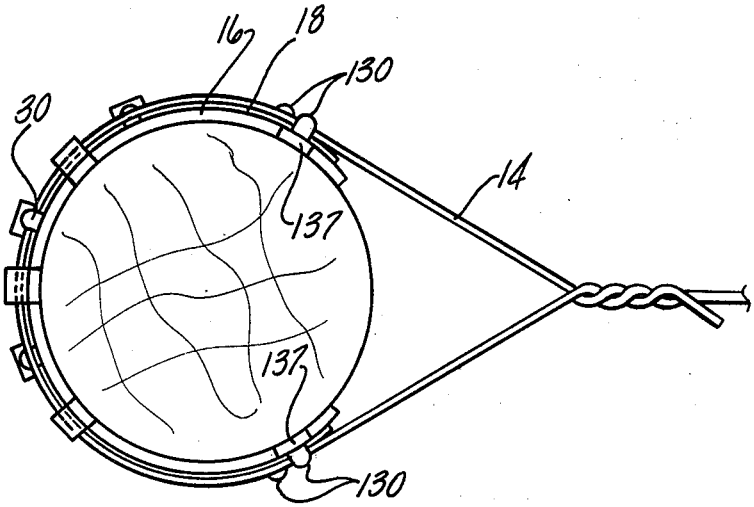
FIG. 2 is a top plan view of a fence post illustrating the use of the wire mounting structure of the invention as employed at a post at the end of a line of fencing.
Figure 3:
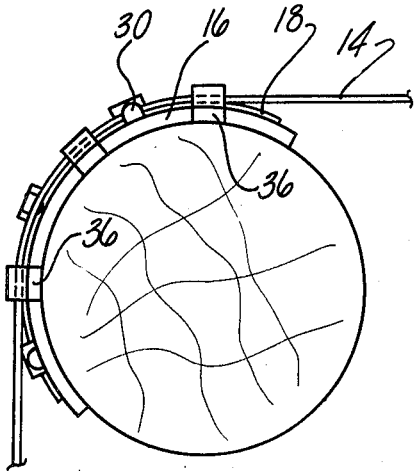
FIG. 3 is a view similar to FIG. 2 illustrating use of the fence wire mounting structure of the present invention in connection with a corner post.

The electric fence wire mounting structure embodying the invention is designated generally at 10 and is adapted to be fastened to a fence post 12 to support an electrically charged wire 14 supported by the mounting structure 10, which wire typically is a high carbon galvanized or plated steel wire which is stretched under loads of as much as two hundred pounds on post 12 spaced apart as much as seventy-five feet. The wire mounting structure 10 of the present invention is particularly adapted for use on posts located at the end of a line of fencing as illustrated in FIG. 2 or at the corner of adjoining fence lines as illustrated in FIG. 3.

Figure 4:
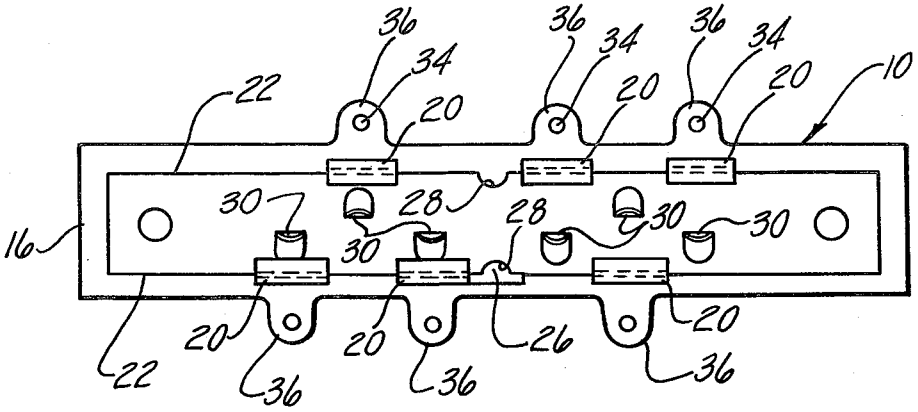
FIG. 4 is a plan view of the fence wire mounting structure of the type used with a corner post as in FIG. 3 but in an unmounted condition.

The fence wire mounting structure 10 includes an elongated flexible strap 16 of electrically non-conductive material such as plastic or rubber and a flexible metal strip 18 forming a wire retainer. Referring to FIG. 4, the metal strip 18 is slightly shorter and narrower than the insulating strap 16 and is held in position on the strap 16 by a number of staggered clip portions 20 which are molded as a unit with the remainder of the strap 16. The clip portions 20 are disposed along opposite edges 22 of the strip 18 and have flange portions 24 which overlie an outer surface of the strip 18 to hold it in engagement with the insulating strap 16.

Also molded integrally with the insulating strap 16 is a locator portion 26 having a thickness slightly greater than the thickness of the metal strip 18. The locator portion 26 is adapted to receive either one of a pair of complementary notches 28 formed in the edges 22 of the metal strip 18 to prevent longitudinal displacement relative to the rubber strap 16. The pair of notches 28 permit placement of the metal strip 18 in either of two positions when it is rotated end for end.

Figure 5:
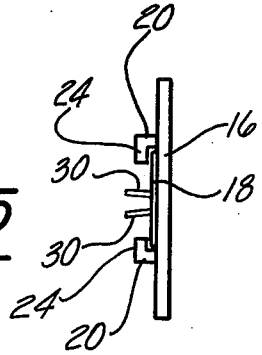
FIG. 5 is an end view of the structure in FIG. 4.

The metal strip 18 preferably is made of galvanized steel sheet material and is provided with a plurality of staggered tabs 30 which are unitary with the metal strip 18 are are formed by stamping a generally U-shaped cut and bending the encompassed material outwardly. As seen in FIG. 5, it is preferred that the tabs 30 be bent at a slight angle to the horizontal so that opposed tabs diverge outwardly relative to each other. Such divergence of the tabs 30 facilitates positioning the wire in the path formed between opposed tabs 30.

With the metal strip 18 assembled to the insulating strap 16, the fence wire mounting structure can be held in a selected location upon a wooden post by means of nails 32 received in holes 34 formed in bracket tabs 36 molded integrally with the insulating straps 16. The tabs 36 are in spaced relation to metal strip 18 to insure separation from the fasteners or nails 32.

One method of installing the fence wire mounting structure 10 is to locate a wire 14 in the path formed between the tabs 30 and to bend the tabs at least slightly which serves to maintain the structure 10 on the wire 14. The mounting structure 10 with the wire 14 may then be bent to engage the post 12 and nails 32 can be inserted through the holes 34 and driven into the post 12 to secure the structure 10 in position.

Figure 1:
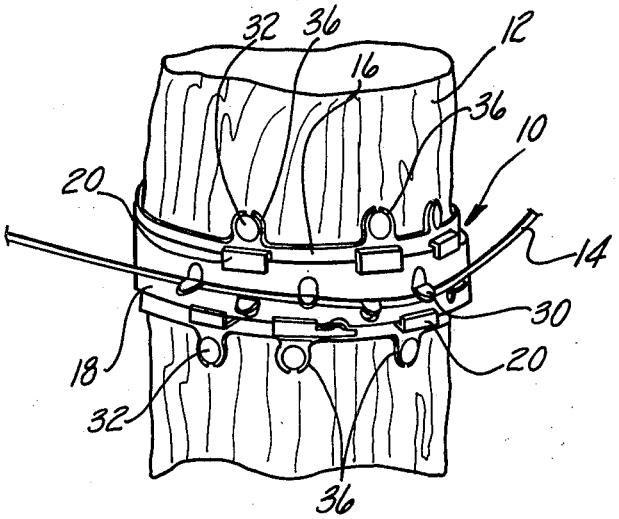
FIG. 1 is a perspective view of a corner post illustrating an embodiment of the invention supporting a fragment of an electric fence wire.
Figure 6:
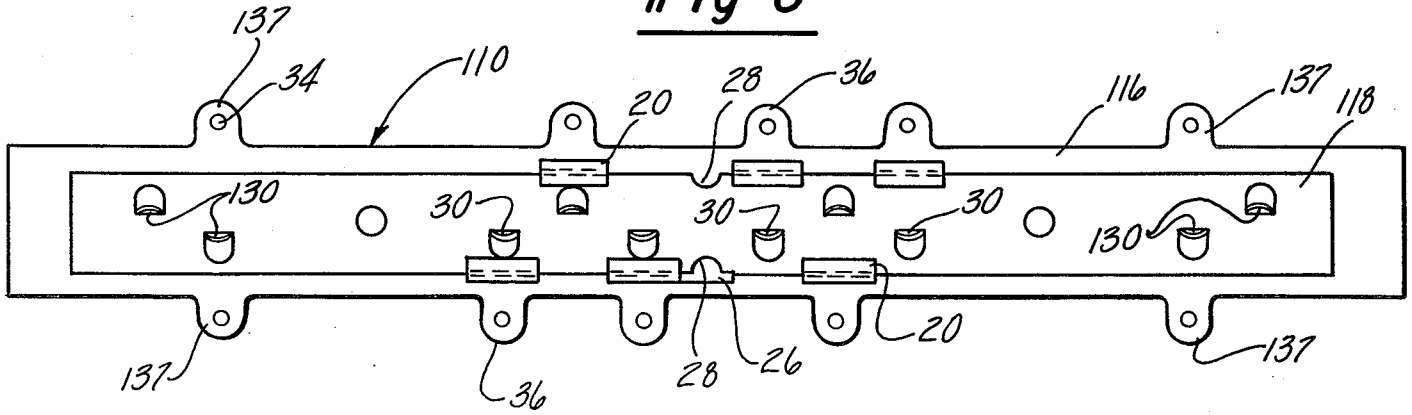
FIG. 6 is a plan view of a fence wire mounting structure of the type adapted for use for posts at the end of a line of fencing as shown in FIG. 2 but in an unmounted condition.

FIGS. 1, 3, and 4 illustrate a form of mounting structure 10 particularly adapted for use at corner posts in which case it is necessary for the metal strip 18 to embrace slightly more than 90 degrees of the post to absorb the loads imposed on it by the wire 14. FIGS. 2 and 6 illustrate a form of mounting structure 110 which is a modification of the mounting structure 10 and is particularly adapted for use at end posts in a line of fencing, such as found adjacent to gates and openings in fence lines.

The principal difference in the mounting structure 110 for use with end posts and the structure 10 is that the entire assembly is slightly longer to engage a greater circumference of the fence posts which typically have diameters of at least three and one-half inches. For this purpose metal strip 118 and rubber strap 116 are longer than in the corner post version. As seen in FIG. 5, this is accomplished by elongating the metal strip 118 and providing a pair of opposed tabs 130 at opposite ends of the metal strip 118. Also, the rubber insulating strap 116 is elongated to be longer than metal strip 118. Also, strap 116 is provided with bracket tabs 137 at opposite ends in addition to tabs 36 of the type used with the mounting structure 10. As shown in FIG. 3, when installed on the corner post, the additional tabs 130 serve to hold postions of the wire 14 at locations spaced slightly more than 180 degrees.

It will be understood that the straps 16 and 116 can be molded of material other than rubber and that other flexible dielectric materials such as plastic can be used. The metal strips 18 and 118 serve to prevent the wire 14 from cutting into relatively softer insulating straps 16 and 116, particularly when the wire is put under relatively high tension loads as with present day electric fencing systems.

Figure 7:
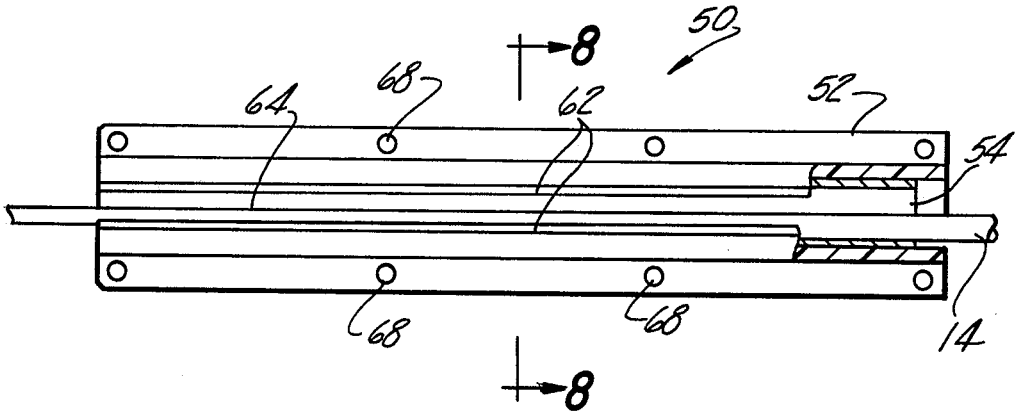
FIG. 7 is a plan view of another embodiment of the invention showing the wire mounting structure prior to attachment to a post.
Figure 8:
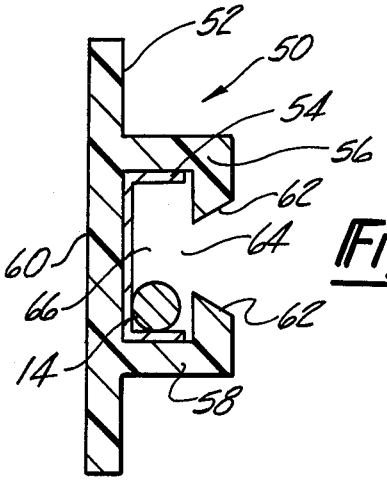
FIG. 8 is a cross-sectional view taken generally on line 8—8 in FIG. 7.

Another embodiment of the invention is shown in FIGS. 7 and 8 in which an electric fence wire mounting structure of another form is designated generally at 50 and includes an elongated strap 52 of electrically non-conductive material and an elongated channel-shaped member 54 which preferably is made of thin galvanized steel sheet material.

The strap 52 also has a general channel shape formed by opposed hook members 56 and 58 formed integrally and as a unit with a base member 60. The strap 52, including the base 60 and hooks 56 and 58, can be extruded from a rubber or a pliable material. The hook members 56 and 58 have cam or guide surfaces 62 defining opposite sides of a gap 64 opening into the cavity 66 containing the channel 54. The guide surfaces 62 facilitate insertion of the channel 54 to the strap 52 by deflecting the hooks 56 and 58. If desired, the metal channel can be inserted into the end of extruded strap 52. Also, the guide surfaces facilitate insertion of the wire 14 into the cavity 66.

Preferably the channel member 54 is slightly shorter than the strap 52 to maintain the metal portions separated by the insulating member 52. The strap 52 and member 54 are uniform throughout their lengths and can be cut to the desired length to embrace slightly more than 90 degrees of the post when the assembly is to be used at the corners of fences or slightly more than 180 degrees when the assembly is to be used at posts at the end of a line of fencing as referred to in FIGS. 3 and 2 in connection with the prior embodiment of the invention.

To use the structure 50 with the channel 54 assembled to the strap 52, the length of wire 14 can be introduced at some intermediate point along the length of wire.

The cam surfaces 62 help to guide the wire 14 into the space 64 between the hook portions 56 and 58.

The gap itself has a width slightly greater than the wire 14 but because of the flexibility of the wire, there is little likelihood of the wire coming into alignment with the gap 64; and the hook portions tend to retain the wire within the space defined by the channel member 54. With the structure supported on the wire 14 the strap 52 and channel 54 can be bent as a unit around the desired perimeter portion of a post and fasteners such as nails can be inserted in holes 68 in the base member 60 to secure the insulating strap 52 to the post. Such a mounting serves to hold the channel 54 and the wire 14 relative to the post unit tension is applied on the wire which will tend to squeeze the wire 14 against the metal channel 54 which distributes the load to the insulating strap and prevents damage to the insulating strap 52.

Figure 9:
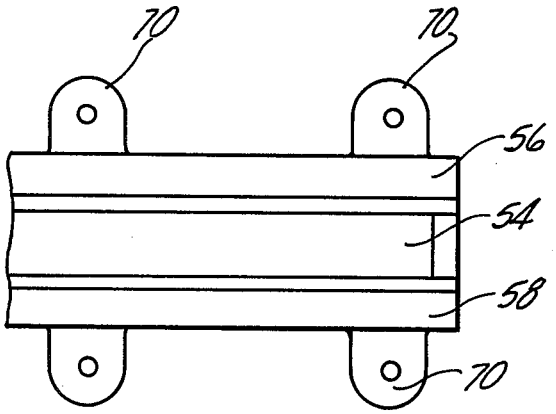
FIG. 9 is a view similar to FIG. 7 showing a modified mounting structure.

As shown in FIG. 7 the insulating strap 52 is uniform in cross-section throughout its length so that it can be made by an extrusion process. If, however, it is preferred to use a molding process, the strap 52 can be provided with tabs 70, as shown in FIG. 9, to form bracket portions for receiving nail fasteners by which the mounting structure can be attached to a post.

An electric fence wire mounting structure has been provided in which a metal retaining strip acts to hold the wire and a rubber insulating strap serves to hold the metal strip and wire in electrically insulated position relative to a wooden post, particularly at the corner of fences or at the end of fence lines. When the wire is highly stressed, the metal prevents cutting the rubber strap which is fastened to the post by fasteners spaced from and insulated from the metal strip. In both embodiments of the invention, the mounting structure can be attached to an intermediate portion of wire thereby obviating the need to thread the mounting structure from the end of the wire.

The embodiments of the invention in which an exclusive property or privelege is claimed are defined as follows:

1. An electric fence wire mounting structure for supporting a high tensioned and electrically charged wire from a generally cylindrical fence post at either a corner or at the end of a line of fencing, comprising: an elongated strap of electrically non-conductive material, an elongated metal retainer, means supporting said retainer in substantially parallel and engaging relation to said strap, and strap and retainer being longitudinally flexible, means on said strap spaced from said retainer to receive fasteners adapted to hold said strap and retainer as a unit around a portion of the circumference of a cylindrical post, said metal retainer including means to receive a wire to extend substantially parallel to said retainer and strap and maintain it in position relative to a post.

2. The electric fence wire mounting structure of claim 1 wherein said flexible metal retainer is channel-shaped and said means to receive a wire are opposed flanges of the channel.

3. The electric fence wire mounting structure of claim 1 wherein said elongated flexible strap has opposed hook members forming said means supporting said retainer.

4. The electric fence wire mounting structure of claim 2 wherein said hook members form opposed cam surfaces for engaging the retainer to deflect said hook members upon assembly of said strap and retainer.

5. The electric fence wire mounting structure of claim 1 wherein said retainer and strap are bendable as a unit to conform to the perimeter of a post.

6. The electric fence wire mounting structure of claim 1 wherein said retainer and strap are of uniform cross-section throughout their entire lengths.

7. An electric fence wire mounting structure for supporting a high tensioned and electrically charged wire from a generally cylindrical fence post at either a corner or at the end of a line of fencing, comprising: an elongated flexible strap of electrically non-conductive material, an elongated flexible metal retainer, means supporting said retainer in engaging relation to said strap, means on said strap spaced from said retainer to receive fasteners adapted to hold said strap and retainer relative to a post, and means to receive a wire and maintain it in position relative to a post, said means to receive a wire being tabs formed integrally with said metal strap.

8. The electric fence wire mounting structure of claim 7 wherein said tabs are bendable relative to said metal retainer to entrap a wire.

9. The electric fence wire mounting structure of claim 7 wherein said tabs are disposed at opposite sides of a path for a wire and wherein opposed tabs at opposite sides of said path are disposed in staggered relationship to each other.

10. The electric fence wire mounting structure of claim 9 wherein said tabs diverge relative to each other prior to receiving a wire.

11. The electric fence wire mounting structure of claim 7 wherein said means supporting said retainer in engaging relation to said strap are clips formed integrally with said flexible strap and disposed at opposite side edges of said retainer to prevent axial displacement of said retainer relative to said strap.

12. The electric fence wire mounting structure of claim 11 and further comprising a locator portion molded integrally with said strap and adapted to receive a complementary locator recess formed on said retainer to limit relative longitudinal displacement of said strap and retainer.

* * * * *

UNITED STATES PATENT AND TRADEMARK OFFICE

CERTIFICATE OF CORRECTION

PATENT NO. : 4,355,201

DATED : October 19, 1982

INVENTOR(S) : Robert M. Wilson, Sr.

It is certified that error appears in the above—identified patent and that said Letters Patent is hereby corrected as shown below:

Column 4, line 23, "unit" should read --until--

Signed and Sealed this

Fifth Day of April 1983

[SEAL]

*Attest:*

GERALD J. MOSSINGHOFF

*Attesting Officer*

*Commissioner of Patents and Trademarks*